US005307873A

United States Patent [19]

Miller

[11] Patent Number: 5,307,873

[45] Date of Patent: May 3, 1994

[54] WATER WELL LOCK

[76] Inventor: Robert H. Miller, 301 N. Main, Templeton, Calif. 93465

[21] Appl. No.: 49,032

[22] Filed: Apr. 16, 1993

[51] Int. Cl.[5] ..... E21B 23/00

[52] U.S. Cl. ..... 166/206

[58] Field of Search ..... 166/206-209, 166/216, 217

[56] References Cited

U.S. PATENT DOCUMENTS

| | | | |
|---|---|---|---|
| 3,112,794 | 12/1963 | Chenoweth | 166/206 |
| 4,058,162 | 11/1977 | Smith | 166/124 |
| 4,116,274 | 9/1978 | Rankin et al. | 166/206 X |
| 4,610,309 | 9/1986 | O'Brien et al. | 166/206 X |
| 4,796,723 | 1/1989 | Lauren et al. | 166/206 X |

*Primary Examiner*—Thuy M. Bui

*Attorney, Agent, or Firm*—Daniel C. McKown

[57] ABSTRACT

A removable lock for installation in a water well having a plastic casing includes a cylindrical body that fits loosely within the plastic casing. The body includes pivotable blades having points that are directed downwardly and outwardly. After the lock has been lowered a substantial distance below the ground into the casing, the blades are forcibly pivoted so that the points of the blades penetrate into the plastic coating. After the lock is thus set, the application of a downward force to the body of the lock will cause the point of the blades to dig deeper into the plastic casing so that the blades cut a slit in the plastic casing if an attempt is made to drive the body downward within the casing. A coupling is included at the top end of the body, and the coupling is engaged to the lower end of a pipe string for moving the lock into the casing and for removing it. To prevent unauthorized removal of the plug, the coupling at the top end of the body is provided with threads of an uncommon type.

6 Claims, 3 Drawing Sheets

WATER WELL LOCK

BACKGROUND OF THE INVENTION

1. Field of the Invention

The present invention is in the field of water wells, and specifically relates to a device that is installed underground in the well to deny access to lower portions of the well.

2. The Prior Art

A number of plugs, seals, locks, and wireline tools have been developed in the oil industry to solve various problems unique to that industry, but on close inspection it will be seen that none of these oil industry devices works in the same manner as the present invention. The present invention requires that the well have a plastic casing. Such casings are almost universally used in water wells, but are not used in oil and gas wells.

For example, in U.S. Pat. No. 3,812,911, Vann shows a retrievable plug that includes locking dogs that can be extended radially outwardly from a plug to engage a circumferential slot. Similarly, in U.S. Pat. No. 4,116,274, Rankin et al. show a wireline latching apparatus that also includes three arms that are pivotally mounted to the apparatus and that can be actuated to an open position in which they engage a downwardly facing shoulder in the casing.

In U.S. Pat. No. 4,058,162, Smith describes a well tool that can be locked within and sealed with respect to the bore of a well. The device has a threaded coupling at the top and a threaded member that operates locking dogs that engage the bore of the well.

In U.S. Pat. No. 4,411,314, Shearhart shows the use of a socket wrench at the lower end of a string of tubing for engaging a hexagonal nut located at the top end of a casing packer for the purpose of rotating the nut.

Thus, although the relevant technology was developed in the oil industry, it will be seen below that the present invention includes distinguishing structural features which adapt it for use in water wells.

SUMMARY OF THE INVENTION

In the United States, water wells are usually drilled by independent contractors who possess the necessary drilling equipment and experience. Ordinarily, the drilling contractor is paid after he completes the drilling of the well. Occasionally, the landowner procrastinates in paying for the well while enjoying the water it produces. Although the drilling contractor has legal remedies he could pursue, in practice obtaining relief may prove to be time-consuming and expensive. As a drilling contractor, the present inventor recognized the need for greater leverage in dealing with the landowner.

After a particularly discouraging episode, the present inventor devised the concept of a lock for a water well. After drilling the well, the drilling contractor instals the lock, which prevents use of the well until it is paid for.

Obviously, the well lock must be tamper-proof, to prevent the landowner from readily removing it. On the other hand, the lock must be readily removable by the drilling contractor and must not produce any permanent damage to the well (unless it is tampered with). Reconciling these requirements was perhaps the greatest contribution of the present inventor.

In accordance with a preferred embodiment of the invention, the well lock is installed in the well casing a substantial distance (typically 50 feet) below the ground level. The depth alone is a serious impediment to tampering, since the landowner ordinarily has no knowledge of what the lock looks like.

Nevertheless, two key steps are taken to prevent tampering with the installed lock. First, the coupling by which the lock is attached to a pipe string for installation employs threads of any uncommon type. For example, the threads may be of an unusual diameter, for example, a metric-size thread. Additionally, the thread used on the coupling may have an uncommon pitch or shape. Thus, even if someone attempted to retrieve the lock from its 50-foot depth, they would find it impossible to get a grip on the lock.

Another way of defeating the lock might be attempted, namely, driving it to the bottom of the well by successive downward blows or by the application of a great weight. To counter this mode of defeating the lock, the inventor has provided the lock with at least one sharp steel blade, the tip of which is brought into engagement with the plastic liner of the well when the lock is set in place. An unauthorized force downward movement of the lock will cause the blade or blades to dig more deeply into the liner, eventually penetrating it and, with further downward movement, producing a downwardly extending slit in the plastic casing of the well. Thus, the landowner cannot dislodge the lock from the depth at which it is installed.

Once the landowner has paid the drilling contractor for his services, the drilling contractor lowers a pipe string having an appropriate thread at its lower end, engages the coupling at the upper end of the lock, releases the blades, and pulls the lock up and out of the well.

The structure by which these operations are accomplished is described more fully below in relation to the accompanying drawings in which a preferred embodiment of the invention is shown. Other embodiments, not shown, are comprehended within the scope and spirit of the present invention.

DETAILED DESCRIPTION OF THE PREFERRED EMBODIMENT

Figure 1:
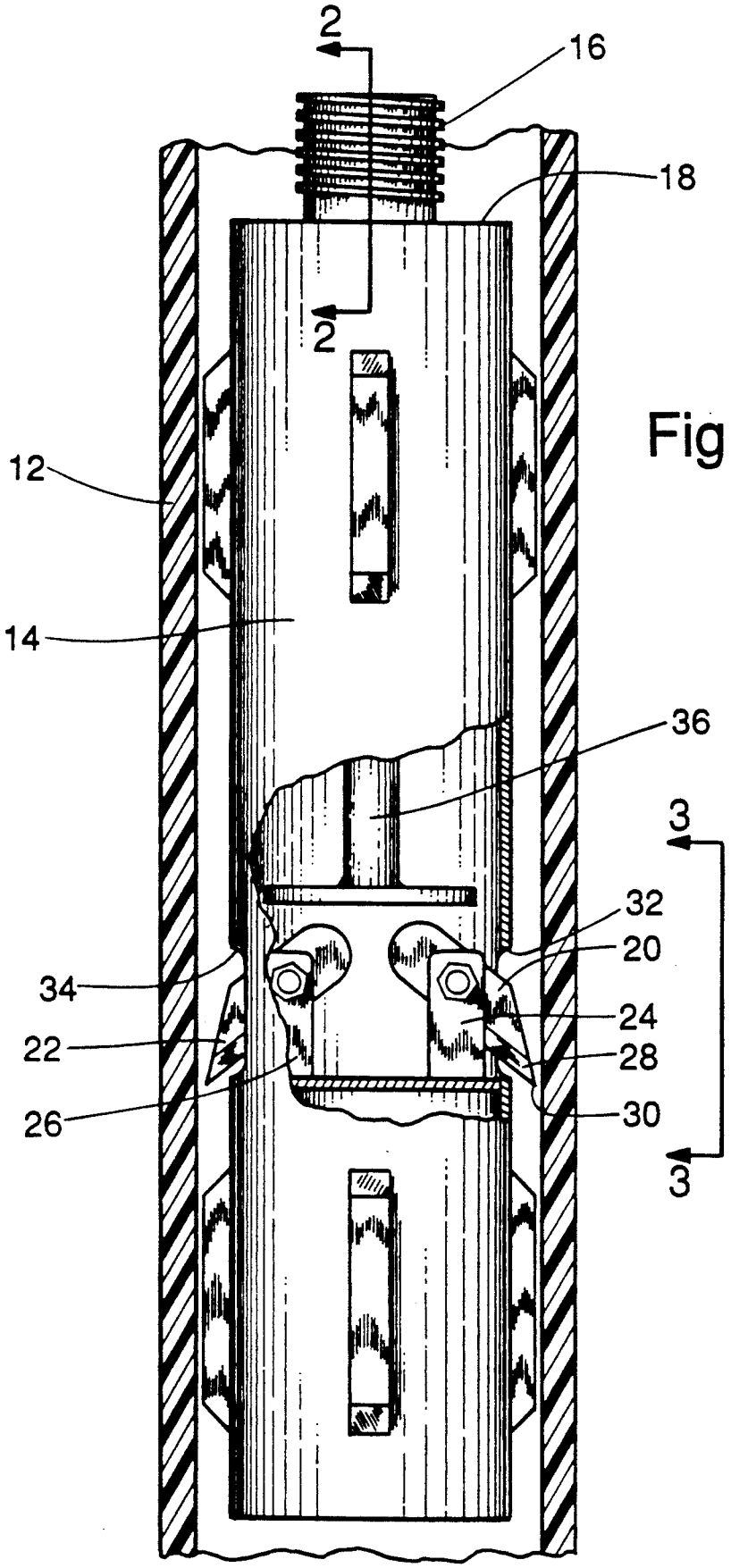
FIG. 1 is a side elevational view in cross section showing the structure of the well lock of the present invention in a preferred embodiment.

In accordance with contemporary practice, the water well in which the removable lock of the present invention is installed is lined with a plastic casing 12. FIG. 1 shows the removable lock after it has been lowered to a location typically 50 feet below the ground but before the lock has been set in place. The lock is lowered into the well at the end of a pipe string (not shown), into which a coupling 16 located at the upper end 18 of the body 14 is screwed.

As shown in FIG. 1, two blades 20 and 22 are pivotally mounted on brackets 24 and 26 for pivotal motion about horizontal axes. Each of the blades includes a sharpened lower edge 28 that tapers outwardly to a point 30. Apertures 32 and 34 permit the points of the blades to pivot outside of the body 14 to engage the casing 12.

Figure 3:
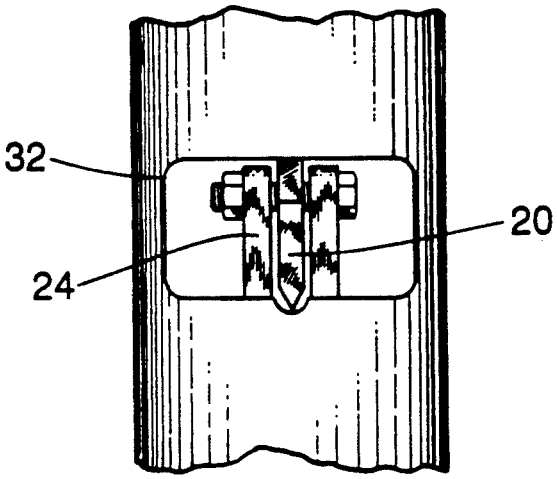
FIG. 3 is a fractional front elevational view showing how the blades are mounted in the lock.

FIG. 3 is a fractional front view in the direction indicated in FIG. 1 showing how the blade 20 is mounted for pivotal motion on the bracket 24 through the aperture 32.

Figure 2:
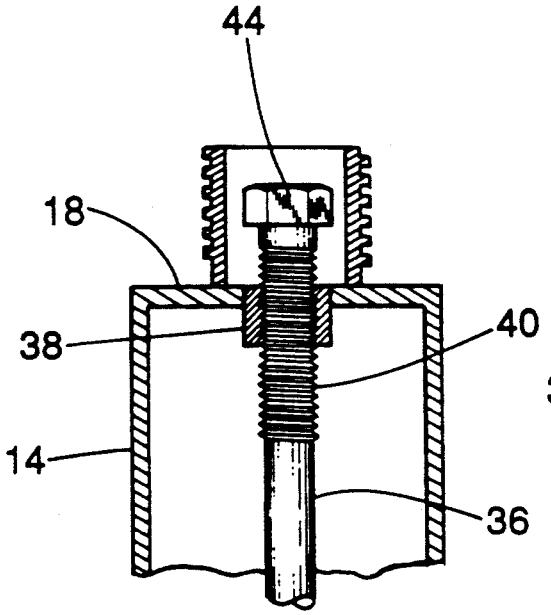
FIG. 2 is a fractional side elevational view in the direction 2—2 indicated in FIG. 1.
Figure 4:
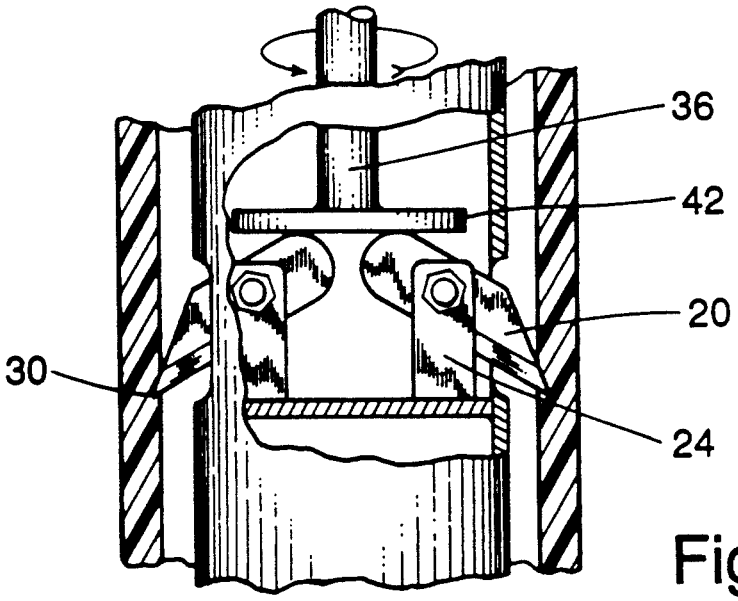
FIG. 4 is a fractional side elevational view partially cut away to show the mechanism for initially setting the blades; and, FIG. 5 is a perspective view with portions cut away to show the lock engaged to the plastic well casing.

FIGS. 2 and 4 show how the blades are set in place. As shown in FIG. 2, a shaft 36 extends from the upper end 18 of the body 14 downwardly to the vicinity of the blades 20 and 22. The body 14 includes a threaded portion 38 that engages a threaded portion 40 of the shaft 36. A disc 42 is affixed to the lower end of the shaft 36, while a head 44 at the upper end of the shaft 36 permits the shaft to be rotated by a socket wrench (not shown) lowered into the well at the end of a pipe string or similar apparatus. Rotation of the head 44 causes the shaft 36 to advance downwardly, causing the disc 42 to press against the radially inward portions of the blades 20 and 22, thereby forcing the blades to pivot so that the points of the blades are driven into the plastic casing 12.

When the blades have been thus set, a strong downward force applied to the body 14 will cause the blades to dig in deeper and to cut slits in the casing 12. This ruins the well, and serves to deter the landowner from attempting to dislodge the removable lock by dropping a weight onto it.

Another technique is used for preventing the landowner from drawing the lock upward by engaging a drill string to the coupling 16. That technique consists of employing threads of an uncommon size (such as a metric thread) or an uncommon pitch or shape on the coupling 16. If the landowner succeeds in lowering a drill string into the well to retrieve the lock, his efforts will be frustrated by the fact that the threaded end of his drill string will not mate with the uncommon threads on the coupling 16. Thus, the landowner will not be able to remove the lock from the position at which it has been set.

Figure 5:
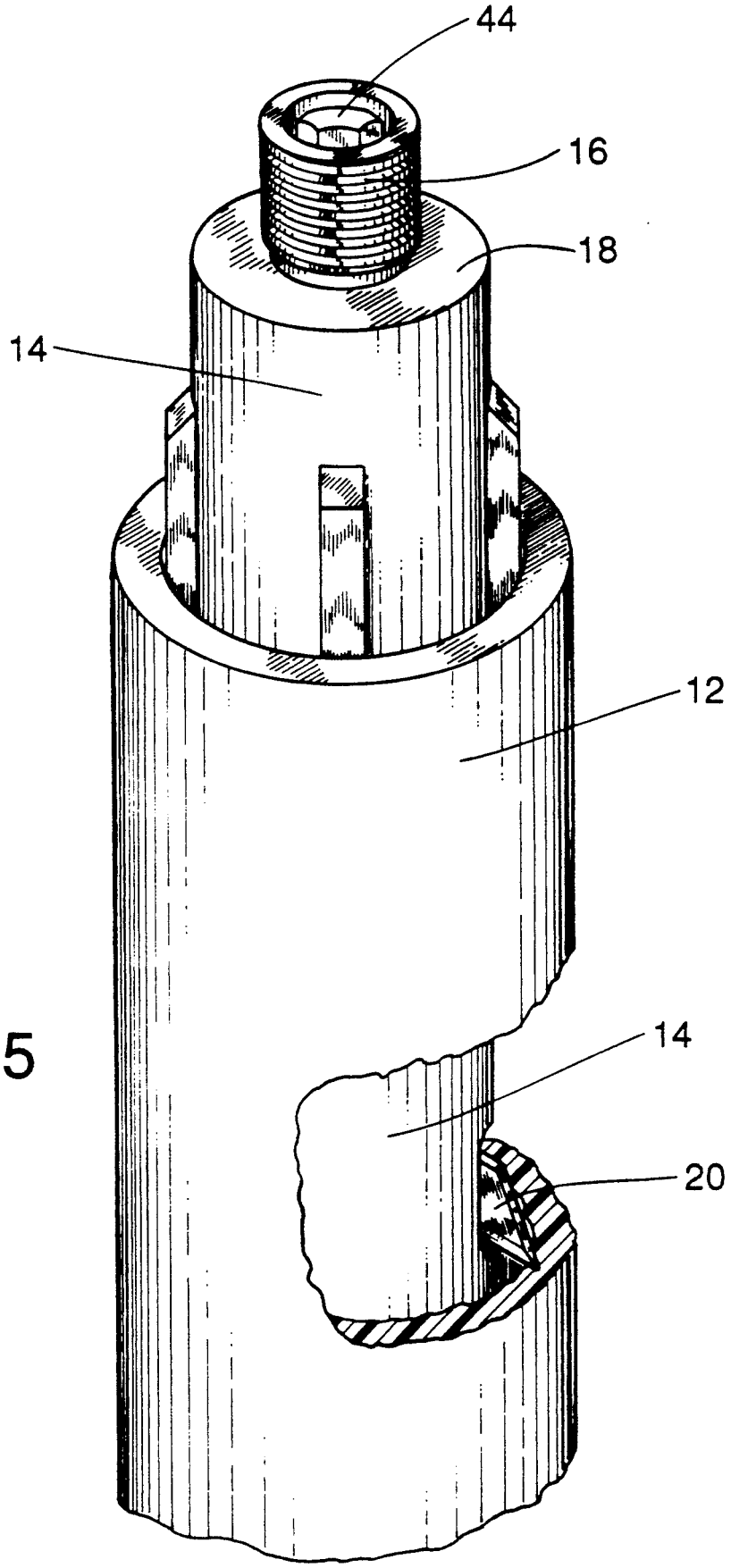

The arrangement of the components is shown in a perspective view in FIG. 5.

Thus, there has been shown and described a removable lock for installation in a water well that has a plastic casing. The removable lock can be installed by the drilling contractor, but cannot be removed by the landowner.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A removable lock for installation in a water well having a plastic casing, comprising in combination:

a body fitting loosely within the plastic casing;

a blade;

first means connecting said blade to said body for pivotal motion about a generally horizontal axis;

said blade including a sharpened lower edge tapering radially outwardly to a point;

second means selectively contacting said blade for forcibly pivoting the point of the blade outwardly beyond said body so as to penetrate into the plastic casing;

whereby, after such penetration, the application of a downward force to said body will cause the point of the blade to dig deeper into the plastic casing and will cause the sharpened lower edge of said blade to cut a slit in the plastic casing if the body is driven downward within the plastic casing, and whereby, when said second means is not contacting said blade, upward movement of said body will free the point of the blade from the plastic casing permitting upward removal of the lock from the water well without harming the casing.

2. The removable lock of claim 1 wherein said body has an upper end, said removable lock further comprising in combination a coupling attached to the upper end of said body to permit a pipe string to be attached to said body for the purpose of installing and removing the removable lock from the plastic casing.

3. The removable lock of claim 2 wherein said coupling includes threads of a diameter not commonly used in water well construction.

4. The removable lock of claim 2 wherein said coupling includes threads of a type not commonly used in water well construction.

5. The removable lock of claim 1 wherein said body has an upper end including a threaded hole and wherein said second means include an actuator having a threaded portion that passes through and engages the threaded hole of the upper end of said body, said actuator having a lower portion that contacts said blade.

6. The removable lock of claim 5 wherein said actuator further includes a nut located above the upper end of said body.

* * * * *